US006220164B1

(12) United States Patent
Laucht et al.

(10) Patent No.: US 6,220,164 B1
(45) Date of Patent: Apr. 24, 2001

(54) SEMICONDUCTOR IGNITER

(75) Inventors: Horst Laucht, Bruckmuehl; Gerhard Mueller, Grafing; Wolfgang Welser, Krichheim, all of (DE)

(73) Assignees: DaimlerChrysler AG, Stuttgart; TRW Airbag Systems GmbH, Aschau a. Inn, both of (DE)

( * ) Notice: Subject to any disclaimer, the term of this patent is extended or adjusted under 35 U.S.C. 154(b) by 0 days.

(21) Appl. No.: 09/288,615

(22) Filed: Apr. 9, 1999

(30) Foreign Application Priority Data

Apr. 9, 1998 (DE) ..... 198 15 928

(51) Int. Cl.[7] ..... F42C 11/00

(52) U.S. Cl. ..... 102/202.5; 102/202.7; 102/202.9

(58) Field of Search ..... 102/202.5, 202.7, 102/202.9

(56) References Cited

U.S. PATENT DOCUMENTS

| | | | | |
|---|---|---|---|---|
| 3,882,324 | * | 5/1975 | Smolker et al. | 102/202.5 |
| 4,393,577 | | 7/1983 | Imai | 29/516 |
| 4,484,523 | | 11/1984 | Smith et al. | 102/202.5 |
| 4,831,933 | | 5/1989 | Nerheim et al. | 102/202.5 |
| 4,976,200 | * | 12/1990 | Benson et al. | 102/202.7 |
| 5,080,016 | | 1/1992 | Osher | 102/202.7 |
| 5,088,413 | * | 2/1992 | Huber et al. | 102/202.5 |
| 5,113,764 | * | 5/1992 | Mandigo et al. | 102/202.9 |
| 5,285,727 | * | 2/1994 | Reams, Jr. et al. | 102/202.5 |
| 5,309,841 | | 5/1994 | Hartman et al. | 102/202.4 |
| 5,327,834 | * | 7/1994 | Atkeson | 102/202.9 |
| 5,370,054 | * | 12/1994 | Reams et al. | 102/202.5 |
| 5,682,008 | * | 10/1997 | Chervinsky et al. | 102/202.7 |

FOREIGN PATENT DOCUMENTS

| | | |
|---|---|---|
| 197 02 118 | 3/1998 | (DE) . |
| 0 314 898 | 5/1989 | (EP) . |
| 0 762 073 A1 | 3/1997 | (EP) . |
| 49-120923 | 11/1974 | (JP) . |
| 56-110247 | 9/1981 | (JP) . |
| 4-018371 | 1/1992 | (JP) . |

* cited by examiner

*Primary Examiner*—Michael J. Carone
*Assistant Examiner*—Glenda L. Sánchez
(74) *Attorney, Agent, or Firm*—Evenson, McKeown, Edwards & Lenahan, P.L.L.C.

(57) ABSTRACT

In the case of a semiconductor igniter, particularly for the gas generator of a protection system for vehicle occupants, consisting of a semiconductor layer which is arranged on a carrier with the insertion of a thermal insulation layer, is connected at the end side to electric contact areas and during the current passage in the ignition path range heats up in an ignition-triggering manner, while maintaining a high ignition efficiency, a mechanically secure linking of the semiconductor layer to the carrier is achieved in that the thermal insulation layer is limited to the ignition path range of the semiconductor layer and the semiconductor layer is connected directly with the carrier at its end sections kept free of the thermal insulation layer.

31 Claims, 2 Drawing Sheets

Fig.1
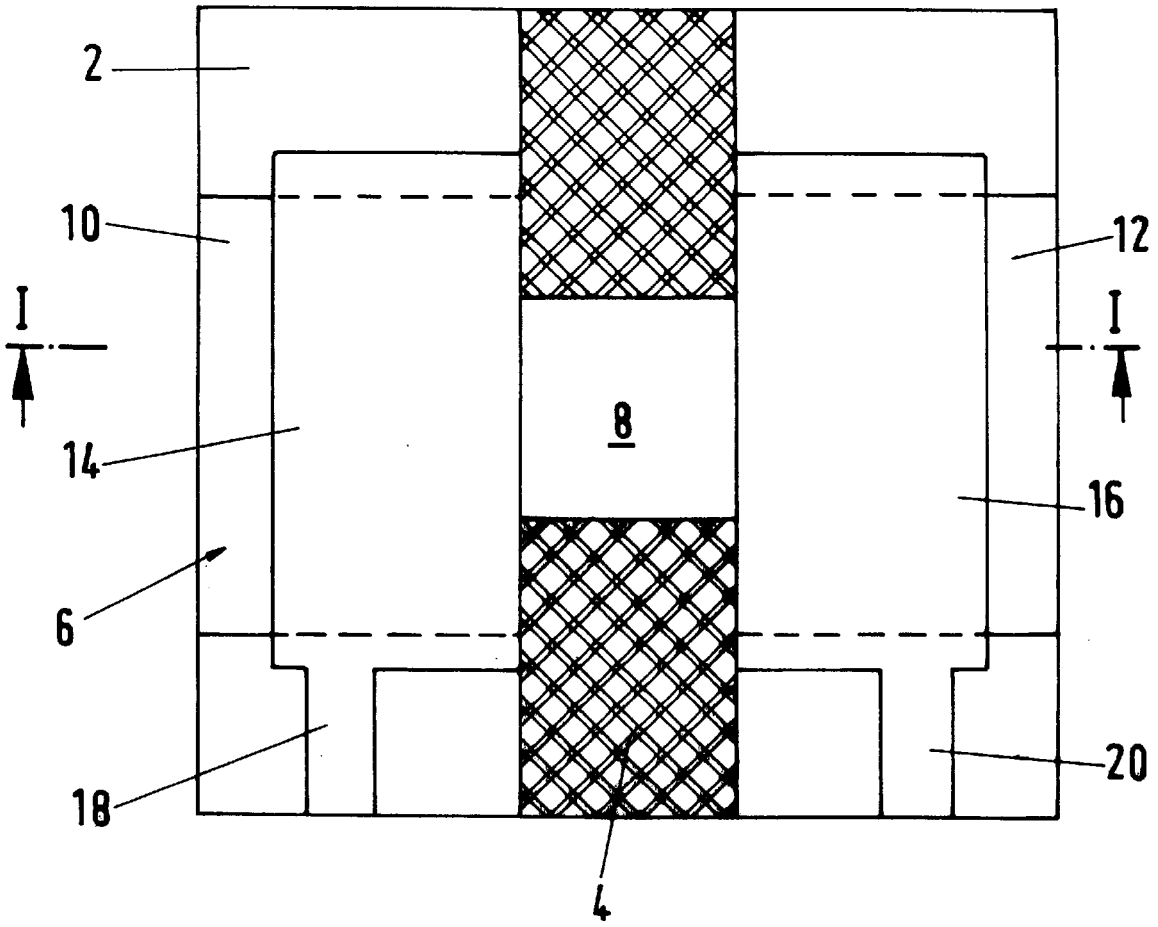
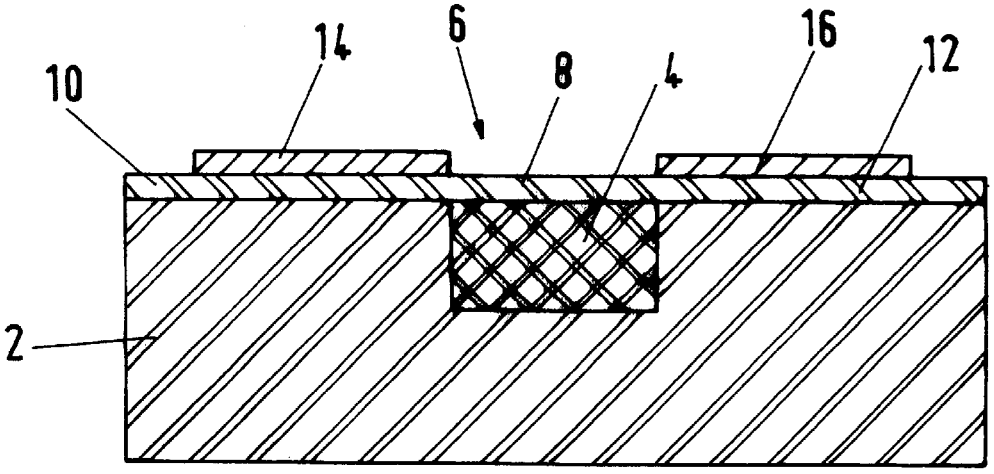
Fig.2

Fig.3
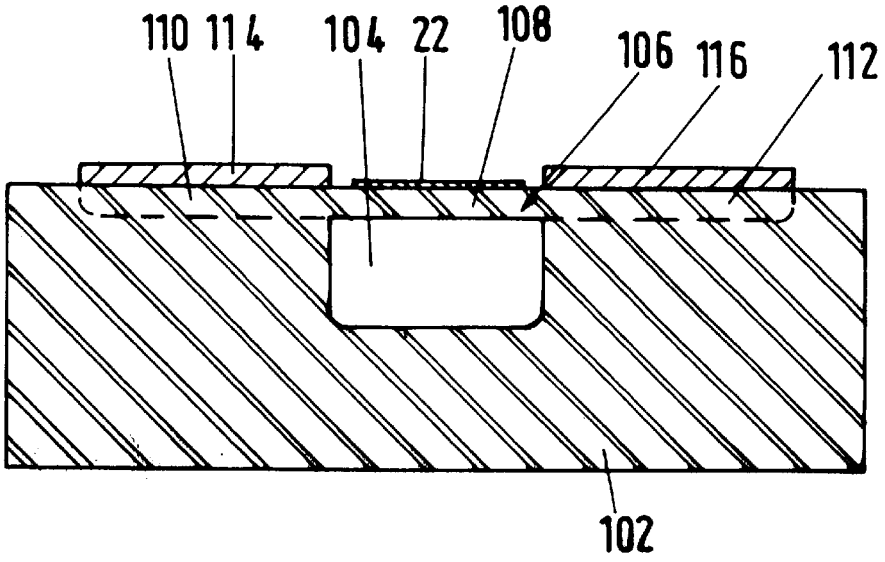
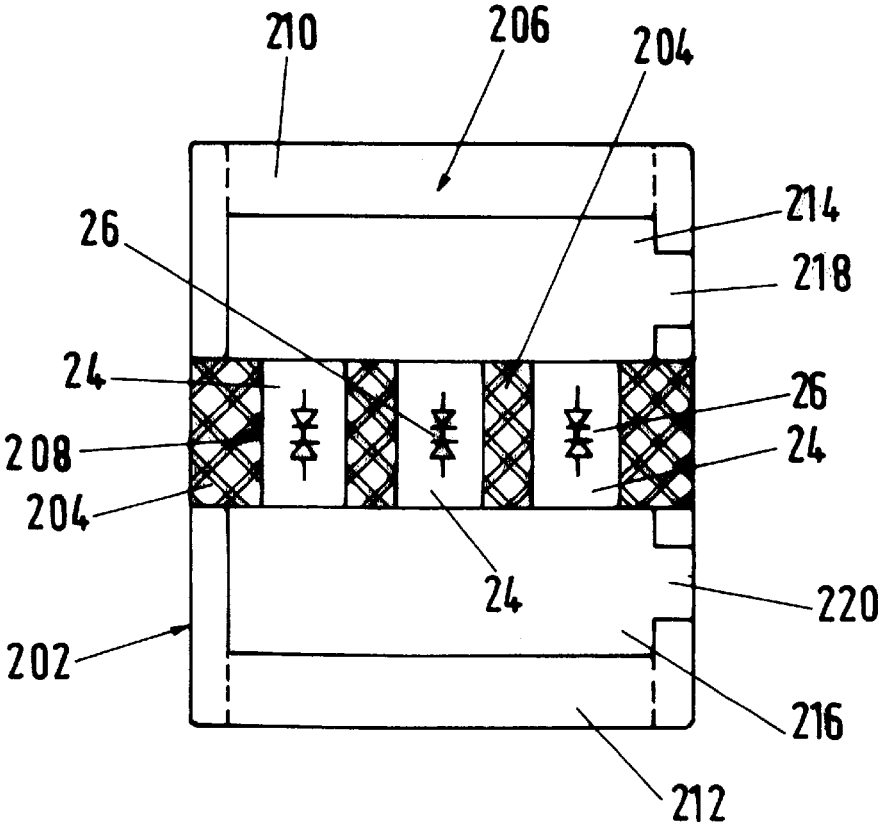
Fig.4

SEMICONDUCTOR IGNITER

BACKGROUND AND SUMMARY OF THE INVENTION

This application claims the priority of German Application No. 198 15 928.5, filed Apr. 9, 1998, the disclosure of which is expressly incorporated by reference herein.

The invention relates to a semiconductor igniter, particularly for the gas generator of a vehicle occupant protection system and, more particularly, to a semiconductor igniter having a semiconductor layer which is arranged on a carrier with the insertion of a thermal insulation layer and is connected at an end side to electric contact areas such that during the current passage in the ignition path range it heats up in an ignition-triggering manner.

Semiconductor igniters of this type, which, in contrast to hot wire igniters, are becoming more prevalent mainly because of their significantly lower interference susceptibility, are known from European Patent document EP 0 762 073 A1 or from U.S. Pat. No. 5,309,841. The semiconductor igniters consist of a considerably p-doped or n-doped semiconductor layer which is arranged between end-side contact pieces on an electrically insulated or non-conducting carrier. During the current passage, while generating an ionized semiconductor plasma, the igniter abruptly heats up and evaporates and, as a result, triggers the ignition—mostly by way of a primary ignition charge. For reasons of a high ignition efficiency, it is required to insert a thermal insulation layer between the semiconductor layer and the carrier. However, as a result, the mechanical bond from the semiconductor layer to the carrier is impaired, and there is the danger that the semiconductor layer may detach under the effect of thermal or dynamic loads as they occur particularly in an application in a motor vehicle, and the semiconductor igniter therefore becomes inoperative.

It is an object of the invention to construct a semiconductor igniter of the above-mentioned type such that a high constructive stability is achieved in a manner which is simple with respect to the manufacturing of the igniter while maintaining a high ignition efficiency.

According to the invention, this object is achieved by a semiconductor igniter, particularly for a gas generator of a vehicle occupant protection system, having a semiconductor layer which is arranged on a carrier with the insertion of a thermal insulation layer and is connected at an end side to electric contact areas such that during the current passage in the ignition path range it heats up in an ignition-triggering manner. The thermal insulation layer is limited to the ignition path range of the semiconductor layer and, on its end sections kept free of the thermal insulation layer. The semiconductor layer is fixedly connected with the carrier.

According to the invention, as a result of the spatial limiting of the thermal insulation layer to the ignition path range of the semiconductor layer in conjunction with a linking of the bridge end sections directly to the support, which link is of the same material and is therefore correspondingly firm, a support of the semiconductor layer is ensured which is extremely stable with respect to the occurring loads. Further, the operational reliability of the semiconductor igniter is significantly improved without additional high-expenditure measures. Nevertheless, the thermal shielding of the ignition path range, which is required for a high ignition efficiency, is fully maintained.

In a particularly preferred further embodiment of the invention, the semiconductor layer is molded on the end sections in one piece to the carrier, whereby an even more secure bond is ensured between the semiconductor layer and the carrier.

For further increasing the stability with a simultaneously high thermal protection effect, it is recommended to produce the thermal insulation layer of a porous material which supports the semiconductor layer in the ignition path range, specifically in a manner which is simple with respect to manufacturing. Here, the carrier material itself is locally made porous, for example, electrochemically. In this case, the material, which is made porous, is preferably oxidized in order to further reduce the thermal conductivity of the insulation layer.

However, optionally, it is also possible to construct the semiconductor layer preferably as a bridge structure which is free-standing in the ignition path range; specifically expediently such that the insulation material, which was first made porous, is removed by etching so that a hollow space is formed as the thermal insulation layer which reaches under the ignition path range. The hollow space is filled with air and can be evacuated as desired. This still further reduces the thermal ignition energy losses.

In a particularly preferred manner, the semiconductor layer is surrounded in the ignition path range by an ignition intensifying medium which burns in an explosive manner when heated, whereby, after a relatively low temperature level has been reached, non-electrically generated heat is made available to the ignition process. According to the invention, the ignition intensifying medium is expediently applied to the semiconductor layer in the form of a coating which is thin with a view to obtaining a short ignition delay. However, when using a porous insulation layer, it is, optionally or additionally, also possible to impregnate the porous insulation material with a gaseous or metal-containing ignition intensifying medium for intensifying the ignition pulse.

According to a preferred embodiment of the invention, the semiconductor layer is divided into several mutually parallel bridge-type webs which are thermally insulated with respect to one another and with respect to the carrier. As a result, in the case of a comparatively large bridge width which is advantageous for creating large contact surfaces for the ignition charge situated above the semiconductor layer, by way of the spaces existing between the bridge-type webs, a thermal insulation layer can be constructed without any problem on the bridge underside.

In a particularly preferable manner, the semiconductor layer is constructed as a semiconductor element which is operated in the blocking direction, heats up in an ignition-triggering manner when the switching voltage is exceeded and has at least a p-n transition junction, thus approximately as a pair of diodes connected antiparallel. This further reduces the interference susceptibility of the semiconductor igniter and produces a pronounced short, sharp ignition pulse.

According to the present invention, the carrier and the semiconductor layer are preferably produced from differently doped silicon, for example, in the form of a silicon wafer.

Other objects, advantages and novel features of the present invention will become apparent from the following detailed description of the invention when considered in conjunction with the accompanying drawings.

BRIEF DESCRIPTION OF THE DRAWINGS

FIG. 1 is a simplified schematic, enlarged top view of a semiconductor igniter according to the invention;

FIG. 2 is a sectional view of the semiconductor igniter according to FIG. 1 along Line I—I;

FIG. 3 is a schematic view of a second embodiment of a semiconductor igniter with a semiconductor bridge, which is molded on in one piece, in a representation corresponding to FIG. 2; and FIG. 4 is a schematic top view of another embodiment of a semiconductor igniter with a multi-part semiconductor bridge.

DETAILED DESCRIPTION OF THE DRAWINGS

The semiconductor igniter illustrated in FIGS. 1 and 2 contains a carrier 2 in the form of a slightly p-doped silicon wafer, a thermal insulation layer 4 formed in the carrier 2 in the shape of a trough; a semiconductor bridge 6 which is also made of silicon but is highly n-doped and which, in the ignition path range 8, is supported on the thermal insulation layer 4 and is applied on the bridge end sections 10, 12 by means of a mechanically fixed link made of the same material, directly to the carrier 2; as well as electric contact pieces 14, 16, which cover the bridge end sections 10, 12 over a large surface area and which are connected with the electronic ignition system (not shown) by way of connection elements 18, 20.

The thermal insulation layer 4 is produced from the carrier material itself such that the carrier 2 is made porous electrochemically or photochemically in a zone which is locally limited to the ignition path range 8 of the semiconductor bridge 6. During the current passage through the semiconductor bridge 6, the thermal insulation layer 4 provides for the electrically generated heat to be largely converted to ignition energy so that the ignition path material heats up abruptly and thereby triggers the ignition in the primary ignition charge (not shown) arranged above the semiconductor bridge 6. At the end sections 10, 12 of the bridge 6, which in contrast are kept free of the thermal insulation layer 4, the semiconductor bridge 6 is securely anchored on the carrier 2 with respect to the occurring thermal and mechanical loads. For improving the thermal protection effect, the porous silicon layer 4 can be oxidized at least on the surface areas adjoining the ignition path range 8.

In order to intensify the ignition pulse, the porous insulation layer 4 is filled with an explosive gas or gas mixture which, when the ignition path 8 is heated, burns abruptly and thereby provides additional thermal energy for the ignition process. Instead, the porous surfaces of the insulation layer 4 can also be coated with a thin ignition-intensifying metal-containing coating which may be deposited by means of the so-called sol-gel process and consists, for example, of Al, Mg, titanium hydride or the like.

In the case of the semiconductor igniter according to FIG. 3, where the elements corresponding to the first embodiment are indicated by a reference number increased by 100, the semiconductor bridge 106 is molded at its end sections 110 and 112 in one piece to the carrier 102. The semiconductor bridge 106 is delimited from the carrier 102 by a different doping, specifically on the semiconductor bridge 106, by a high n-silicon doping and, in the area of the carrier 102, by a low p-silicon doping. Another difference is the fact that, in this embodiment, the thermal insulation layer consists of a hollow space 104 which is filled with air, can be evacuated as desired, and is worked into the carrier material in a trough-shaped manner. For this purpose, the carrier material below the later ignition path range 108 is first made porous again electrochemically or photochemically. Subsequently, the porous silicon material is removed by undercutting so that the hollow space 104 is created. The hollow space 104 reaches under the ignition path range 108 and extends to the bridge end sections 110, 112. As an alternative, the hollow space 104 can also be formed directly by means of a plasma-type etching attack. For intensifying the ignition, a thin metallic coating 22 is again provided, which in this case is applied to the ignition path range 108 and is made of Al, Mg, titanium hydride or the like. The construction and method of operation of the semiconductor igniter according to FIG. 3 is otherwise the same as in the first embodiment.

In the case of the semiconductor igniter according to FIG. 4, where the elements corresponding to the previous embodiments are indicated by a reference number increased by 200, the carrier 202 and the semiconductor bridge 206 are made in the same manner as according to FIG. 3 in one piece from a silicon wafer. However, here the silicon material, which is made porous, is not etched away below the ignition path range 208 but remains as a thermal insulation layer 204. Furthermore, the semiconductor bridge 206 is divided in the ignition path range 208 into several mutually parallel bridge webs 24. This is done in order to, in the case of a large bridge width which is advantageous for a large-surface initiation of the primary ignition charge situated above the semiconductor bridge 206, be able to carry out the electrochemical etching process for making the insulation layer 204 porous. The etching process is carried out by way of the spaces between the bridge webs 24 without any problem, that is, without an excessively high driving-in depth and therefore thickness of the insulation layer 206. Instead of being divided into parallel bridge webs 24, the semiconductor bridge 206 may also be provided with a plurality of etching holes or etching slots by way of which the etching process is then carried out for manufacturing the thermal insulation layer 204.

According to FIG. 4, the semiconductor bridge 206 is constructed on its bridge webs 24 in the manner of a semiconductor element provided with several p-n transitions (junctions), thus approximately—as illustrated—as an antipolar-connected pair of diodes 26 which are operated in the blocking direction and, when the turnover voltage is exceeded, heats up in an ignition-pulse-generating manner. This further reduces the interference susceptibility of the semiconductor igniter and results in an even steeper ignition pulse.

Typically, the semiconductor bridge has a wall thickness between 1 and 10 $\mu$m; a length between 20 and 1,000 $\mu$m; and a width between 20 and 300 $\mu$m (according to FIG. 4, the bridge length amounts to approximately 100 $\mu$m and the bridge width amounts to approximately 200 $\mu$m). The thickness of the thermal insulation layer corresponds to approximately half the bridge width or web width and amounts to approximately 30 $\mu$m; that of the metallic ignition intensifying layer 22 amounts to approximately 0.5 $\mu$m; and the semiconductor igniter has an overall height of approximately 500 $\mu$m.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A semiconductor igniter, comprising:

a semiconductor layer which is arranged on a carrier;

a thermal insulation layer formed in said carrier, the semiconductor layer having end sections with each of said end sections being connected to respective electric contact areas and, during passage of a current in an ignition path range, said semiconductor layer heats up in an ignition-triggering manner, wherein the thermal insulation layer is limited to the ignition path range of the semiconductor layer and, on each of said end sections, the semiconductor layer is kept free of the thermal insulation layer, said semiconductor layer being fixedly connected with the carrier.

2. Semiconductor igniter according to claim 1, wherein at the end sections, the semiconductor layer is molded in one piece to the carrier.

3. Semiconductor igniter according to claim 1, wherein the thermal insulation layer is composed of a porous material which supports the semiconductor layer in the ignition path range.

4. Semiconductor igniter according to claim 3, wherein the porous material comprises carrier material made porous.

5. Semiconductor igniter according to claim 3, wherein the porous material is oxidized.

6. Semiconductor igniter according to claim 1, wherein the thermal insulation layer comprises a hollow space etched out of the carrier material.

7. Semiconductor igniter according to claim 6, wherein the hollow space is formed by removing porous insulation material forming the thermal insulation layer.

8. Semiconductor igniter according to claim 1, wherein the semiconductor layer is surrounded in the ignition path range by an ignition intensifying medium which burns explosively when heated.

9. Semiconductor igniter according to claim 8, wherein the ignition intensifying medium comprises a coating applied locally to the semiconductor layer.

10. Semiconductor igniter according to claim 8, wherein a gaseous or metal-containing ignition intensifying medium is charged into the porous insulation material forming the thermal insulation layer.

11. Semiconductor igniter according to claim 1, wherein the semiconductor layer is divided into several mutually parallel bridge webs which are thermally insulated with respect to one another and with respect to the carrier.

12. Semiconductor igniter according to claim 1, wherein the semiconductor layer is constructed in the ignition path range as a semiconductor element which is operated in a blocking direction and, when a breakdown voltage is exceeded, heats up in an ignition triggering manner and has at least one p-n transition.

13. Semiconductor igniter according to claim 12, wherein the semiconductor element is a pair of diodes.

14. Semiconductor igniter according to claim 1, wherein the carrier and the semiconductor layer are formed of differently doped silicon.

15. Semiconductor igniter according to claim 1, wherein the semiconductor igniter is used for igniting a gas generator of a vehicle occupant protection system.

16. A semiconductor ignition device, comprising:

a carrier;

a semiconductor layer fixedly connected with the carrier, the semiconductor layer having an ignition path range and end sections;

a thermal insulation layer formed in the carrier, said thermal insulation layer being limited to the ignition path range of the semiconductor layer, wherein the end sections of the semiconductor layer are free of the thermal insulation layer; and electric contact areas coupled to the semiconductor layer, wherein when current is passed through the ignition path range, the semiconductor layer heats up in an ignition-triggering manner.

17. The semiconductor ignition device according to claim 16, wherein said end sections are molded in one piece with the carrier.

18. The semiconductor ignition device according to claim 16, wherein the thermal insulation layer is a porous material supporting the semiconductor layer in the ignition path range.

19. The semiconductor ignition device according to claim 16, wherein the thermal insulation layer comprises a hollow space in the carrier.

20. The semiconductor ignition device according to claim 16, further comprising an ignition intensifying medium surrounding the ignition path range, said medium burning explosively when heated.

21. The semiconductor ignition device according to claim 20, wherein the ignition intensifying medium comprises a coating locally applied to the semiconductor layer.

22. The semiconductor ignition device according to claim 20, wherein the ignition intensifying medium is one of a gaseous and metal-containing medium charged into the thermal insulation material which is a porous material.

23. The semiconductor ignition device according to claim 16, wherein the semiconductor layer is divided into a plurality of mutually parallel bridge webs, said webs being thermally insulated with respect to one another and with respect to the carrier via the thermal insulation layer.

24. The semiconductor ignition device according to claim 16, wherein the ignition path range comprises a semiconductor element operated in a blocking direction such that, when a breakdown voltage is exceeded, the semiconductor element heats up in the ignition triggering manner.

25. The semiconductor ignition device according to claim 24, wherein the semiconductor element is a pair of diodes.

26. The semiconductor ignition device according to claim 16, wherein the carrier and the semiconductor layer are made of silicon with different doping.

27. A method of manufacturing a semiconductor ignition device having a semiconductor layer, a carrier, and a thermal insulation layer, the semiconductor layer being connected at end sides to electrical contacts, the method comprising the acts of:

fixedly connecting the semiconductor layer with the carrier;

forming a thermal insulation layer in the carrier adjacent an ignition path range of the semiconductor layer, end sections of the semiconductor layer being spaced away from the thermal insulation layer.

28. The method according to claim 27, wherein the fixedly connecting act comprises the act of molding the semiconductor layer in one piece with the carrier.

29. The method according to claim 27, wherein the act of forming the thermal insulation layer comprises the act of making porous a portion of the carrier.

30. The method according to claim 28, further comprising the act of oxidizing the portion of the carrier made porous.

31. The method according to claim 26, wherein the act of forming the thermal insulation layer comprises the act of etching a hollow space out of the carrier.

* * * * *